US005974600A

United States Patent [19]

Pucci et al.

[11] Patent Number: 5,974,600

[45] Date of Patent: Nov. 2, 1999

[54] SPA COVER

[75] Inventors: Joseph Pucci, Hinckley; Alex Pucci, Strongsville, both of Ohio; James E. Danchulis, Pittsburgh, Pa.

[73] Assignee: Hercules Products, Inc., Brunswick, Ohio

[21] Appl. No.: 09/172,823

[22] Filed: Oct. 15, 1998

[51] Int. Cl.[6] ..... E04H 4/06

[52] U.S. Cl. ..... 4/498

[58] Field of Search ..... 4/498, 503, 580

[56] References Cited

U.S. PATENT DOCUMENTS

| | | |
|---|---|---|
| 3,418,667 | 12/1968 | Powlan . |
| 3,683,428 | 8/1972 | Morris . |
| 4,422,192 | 12/1983 | Jacobs . |
| 4,853,985 | 8/1989 | Perry . |
| 4,857,374 | 8/1989 | Perry . |
| 4,991,238 | 2/1991 | Forrest . |
| 5,048,153 | 9/1991 | Wall et al. . |
| 5,086,525 | 2/1992 | Christopher . |
| 5,131,102 | 7/1992 | Salley et al. . |
| 5,373,590 | 12/1994 | Svae et al. . |
| 5,386,597 | 2/1995 | O'Neill . |
| 5,398,350 | 3/1995 | Watkins et al. . |
| 5,471,685 | 12/1995 | Cross . |
| 5,517,703 | 5/1996 | Ouelette . |
| 5,566,403 | 10/1996 | Black et al. . |
| 5,619,759 | 4/1997 | Hansen et al. . |
| 5,634,218 | 6/1997 | Ouelette . |
| 5,644,803 | 7/1997 | Wilson . |
| 5,685,031 | 11/1997 | Watkins et al. . |
| 5,687,432 | 11/1997 | Genzel . |
| 5,689,841 | 11/1997 | Black et al. . |
| 5,745,932 | 5/1998 | Barovetto . |
| 5,761,750 | 6/1998 | Mazzola et al. . |

*Primary Examiner*—Robert M. Fetsuga
*Attorney, Agent, or Firm*—Pearne, Gordon, McCoy & Granger LLP

[57] ABSTRACT

A bi-folding spa cover and lift for installing and removing the spa cover are disclosed. The cover includes a pair of cover members which each cover about one-half of the spa. Each cover member consists of a pair of structural plastic panels pivotably secured together so that the cover members can outwardly fold in opposite directions. A flat bottom surface of the panels rests on and overlaps a rim of the spa. A flat rubber gasket secured to the bottom of the panels engages the rim and seals the spa cover to the spa. The lift includes a pair of lift assemblies, each connected to an associated one of the cover members. Each lift assembly includes a pair of vertically extending and horizontally spaced-apart rails positioned beside the spa, a pair of blocks each linearly movable along the rails, and a pair of hinges each secured between an associated one of the blocks and the associated one of the cover members. Whereby the cover members are pivotable relative to the blocks about the hinges between a generally horizontal cover position located over the spa and a generally vertical intermediate position located adjacent and above the spa and linearly movable along the rails with the blocks between the intermediate position and a generally vertical storage position located adjacent and beside the spa. Each hinge preferably has a spring element associated therewith to provide a lift assist when pivoting the cover members from the cover position to the intermediate position. Each block preferably has a gas spring associated therewith to provide a lift assist when raising the cover members from the storage position to the intermediate position and to dampen movement along the rails.

28 Claims, 5 Drawing Sheets

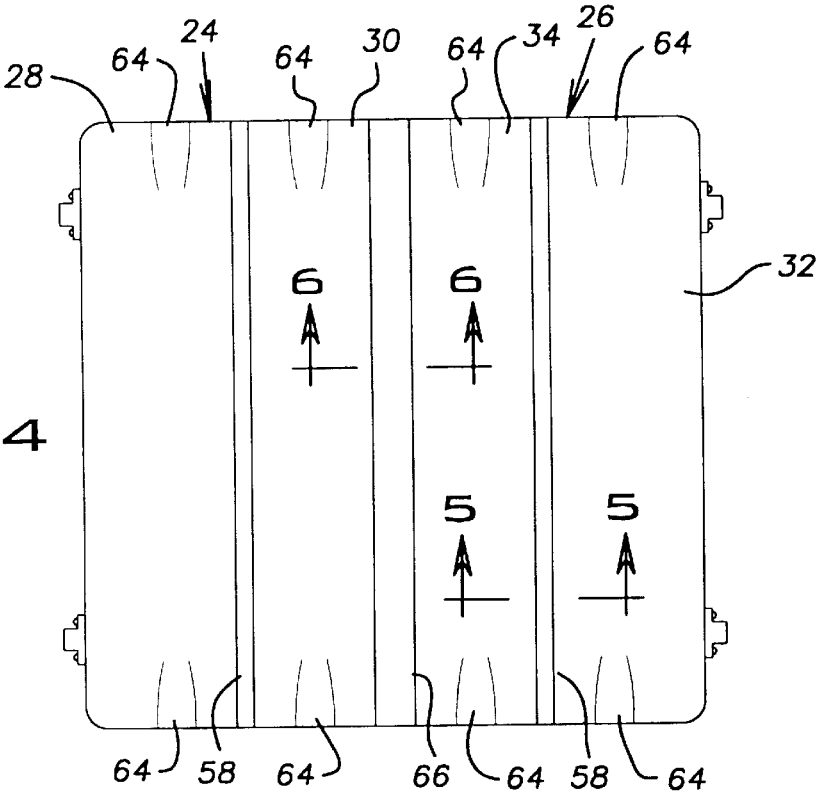
FIG. 4
FIG. 5
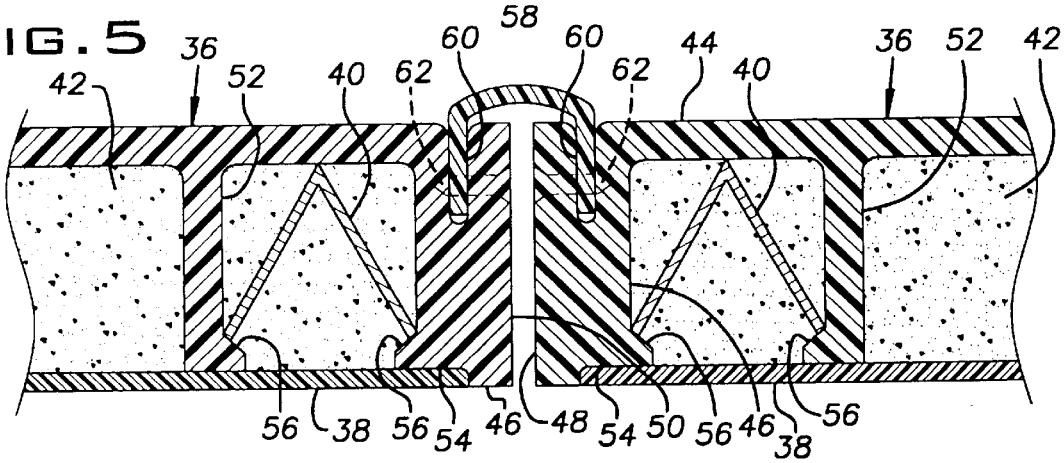
FIG. 6
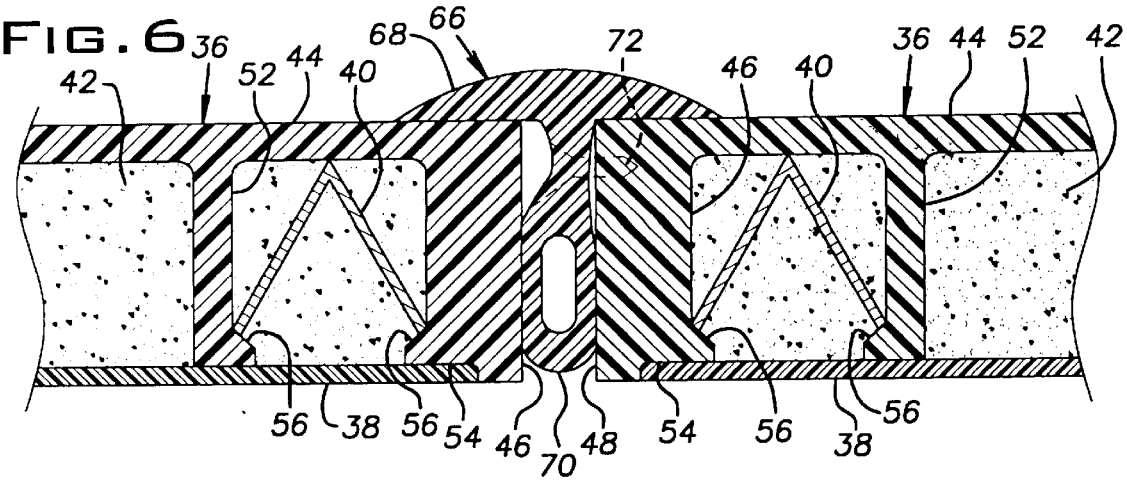

SPA COVER

BACKGROUND OF THE INVENTION

The present invention is generally directed to a cover and lift for a spa or hot tub and, more particularly, to such a cover which is bi-folding and a formed of structural plastic.

It is desirable to cover the open top of a spa or hot tub to prevent dirt or other debris from falling into the spa water and to help retain heat of the spa water which is typically 100+ °F. One conventional spa cover employs a foam material which is covered with fabric. Such conventional spa covers are formed of one piece to cover the entire upper or top surface of the spa. As such, these conventional spa covers are bulky and difficult to move both onto and off of the spa. Also, the foam material tends to absorb water after being placed upon the spa, further adding to the bulkiness of the cover and limiting the usefulness of the cover by making manipulation thereof difficult. Furthermore, such foam spa covers do not have good insulating properties and therefore are not generally useful to help maintain the temperature of the spa water.

In order to avoid some of these disadvantages presented by one-piece foam spa covers, numerous removable covers have been developed. Typically, these covers are modifications of the solid or one-piece cover to permit the cover to be more easily removed and replaced. Such covers typically have a link or arm mechanism to facilitate manipulation of the cover relative to the spa. See, for example, U.S. Pat. Nos. 4,853,985, 4,991,238, 5,471,685, and U.S. Pat. No. 5,517, 703, the disclosures of which are expressly incorporated herein in their entirety by reference.

Accordingly, there exists a need in the art for a spa cover which is easy to manipulate onto and off of the spa, is conveniently stored when not in use, has good heat insulating properties, fits spas of various sizes and/or is easily adapted to fit spas of numerous sizes, has a relatively long useful life, and is easy to assemble and repair.

BRIEF SUMMARY OF THE INVENTION

The present invention provides a spa cover and lift therefor, as well as a method for removing and installing a spa cover, which overcomes at least some of the above-noted problems of the related art. According to the present invention, the cover includes a first cover member having first and second panels and a second cover member having third and fourth panels. Each of the panels are formed of a rigid structural plastic. The first panel has a top surface, a bottom surface adapted to engage the spa rim, and an inner edge. The second panel has a top surface, a bottom surface adapted to engage the spa rim, an inner edge, and an outer edge adapted to abut the inner edge of the first panel. A first hinge connects the first panel and the second panel such that the upper surface of the second panel is pivotable onto the upper surface of the first panel. The third panel has a top surface, a bottom surface adapted to engage the spa rim, and an inner edge. The fourth panel has a top surface, a bottom surface adapted to engage the spa rim, an inner edge adapted to abut the inner edge of the second panel, and an outer edge adapted to abut the inner edge of the third panel. A second hinge connects the third panel and the fourth second panel such that the upper surface of the fourth panel is pivotable onto the upper surface of the third panel. Constructed in this manner, the inner panel of each panel member can be folded or pivoted outwardly in opposite directions onto the outer panels to expose the central portion of the spa. The folded panel members can then be removed to expose the entire spa. The bi-folding configuration enables the panels to be easily stored beside the spa and substantially below the spa rim where they are essentially hidden.

In a preferred embodiment of the present invention, the bottom surface of each panel is substantially flat so that the panels are supported on and overhang the spa rim in a "table-top" manner. The spa cover, therefore, can be utilized on a range of spa sizes. Preferably, the panels are filled with a foam insulation and are provided with a seal member to seal the panels to the spa rim. Therefore, the R-value of the spa cover is substantially improved relative to prior art covers.

According to another aspect of the present invention, a lift assembly includes first and second vertically extending and laterally spaced apart rails adapted to be secured adjacent one side of the spa. First and second blocks are vertically movable along the first and second rails respectively and first and second hinges are secured to the first and second blocks respectively and secured to the cover. The cover is pivotable relative to the blocks about the hinges between a generally horizontal cover position over the spa and a generally vertical intermediate position located adjacent and above the spa and linearly movable with the blocks along the rails between the intermediate position and a storage position located adjacent and beside the spa. The bi-folding cover of the present invention preferably uses two of the lift assemblies which are located on opposite sides of the spa. Each lift assembly is associated with one of the cover members.

In a preferred embodiment of the present invention, the hinges of the lift assembly each have a spring element associated therewith to bias the hinges and the cover toward the intermediate position. The spring element provides a force which assists manual pivoting of the cover from the cover position to the intermediate position. The blocks each preferably have a gas spring associated therewith to upwardly bias the blocks and the cover toward the intermediate position. The gas spring provides a force which assists manual lifting of the cover from the storage position to the intermediate position and provides a force which at least prevents the cover member from rapidly dropping from the intermediate position to the storage position.

According to yet another aspect of the present invention, a method of installing and removing a spa cover includes the step of pivoting a cover panel between a cover position wherein the panel is generally horizontal and is located over the spa and an intermediate position wherein the panel is generally vertical and located adjacent and above the spa. The method also includes the step of linearly moving the panel between the intermediate position and a storage position wherein the panel is generally vertical and is located adjacent and beside the spa. In a preferred embodiment, the cover has at least two panels hinged together and the method includes the step of folding the additional panel onto and off of the panel when the panel is in the cover position.

BRIEF DESCRIPTION OF THE SEVERAL VIEWS OF THE DRAWING

These and further features of the present invention will be apparent with reference to the following description and drawings, wherein:

FIG. 4 is a top plan view of the spa of FIG. 1;

FIG. 5 is an enlarged sectional view taken along line 5—5 of FIG. 4;

FIG. 6 is an enlarged sectional view taken along line 6—6 of FIG. 4;

DETAILED DESCRIPTION OF PREFERRED EMBODIMENTS

Figure 1:
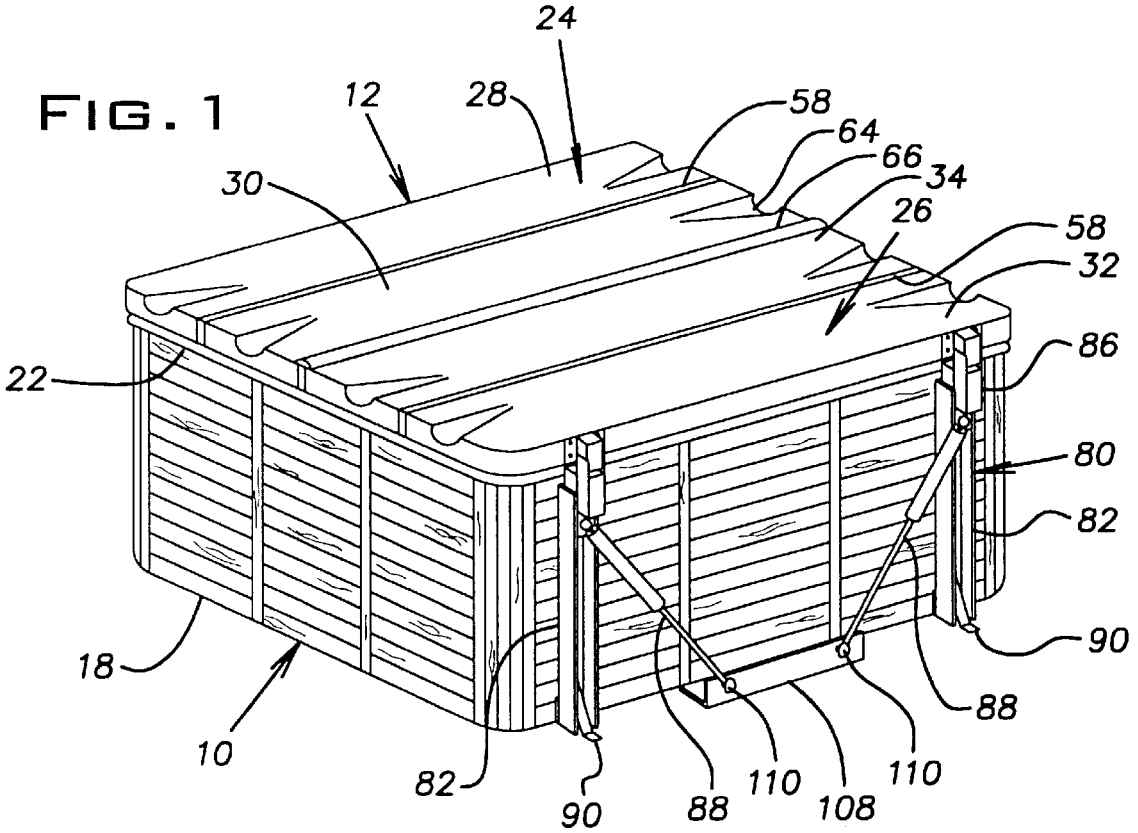
FIG. 1 is a perspective view of a spa having a cover and a cover lift assembly according to the present invention wherein the cover is in a cover position located over the spa.

FIGS. 1–4 illustrate a spa or hot tub 10 having a spa cover 12 and a lift 14 for the spa cover 12 according to the present invention. Conventionally, such spas 10 include a tub 16 and an exterior support structure 18 for the tub 16.

The tub 16 can be fabricated of various materials such as fiberglass, acrylic, thermoplastics, and the like. The tub 16 has a top opening providing access to heated water contained in the tub 16 and a flange or rim 20 encircling the opening. In the illustrated embodiment the rim 20 is rectangular shaped. The rim 20 typically has a substantially flat, horizontal upper surface but it can be curved or arcuate. The spa cover 12 according to the present invention makes use of this rim 20 for both support and sealing purposes, as will be apparent to one skilled in the art with reference to the following drawings and description.

The support structure 18 can be fabricated of wood and often includes decorative redwood patterns. In the illustrated embodiment, the support structure 18 is rectangular shaped. The support structure 18 also has a rectangular flange or rim 22 located below the rim 20 of the tub 16. In the illustrated embodiment, the rim 22 of the support structure 18 outwardly extends further than the rim 20 of the tub 16. It is noted that alternatively the tub 16 can be "free standing", that is, the tub 16 can be constructed to have an integral support structure wherein the separate support structure is not necessary.

The spa cover 12 is formed of two halves or cover members 24, 26, each including an outer panel assembly 28, 32 and an inner panel assembly 30, 34 pivotally attached to the outer panel 28, 32. Therefore, the spa cover 12 includes four panel assemblies 28, 30, 32, 34 configured in a bi-folding manner. Preferably, the cover members 24, 26 are substantially identical to one another. However, there are differences between the cover members 24, 26, mostly at the interface between the cover members 24, 26 as will be described in more detail hereinafter.

The panel assemblies 28, 30, 32, 34, are sized to cover the top opening when lying flat and are supported on the rim 20 of the spa tub 16. In the illustrated embodiment, the panel assemblies 28, 30, 32, 34 are generally elongate rectangles of substantially equal size wherein the length of each panel assembly 28, 30, 32, 34 is generally equal to the length of the tub rim 20 and the width of each panel assembly 28, 30, 32, 34 is generally equal to ¼ the width of the tub rim 20. For example, a 96×96 inch spa cover 12 can be obtained by each panel assembly 28, 30, 32, 34 having a length of about 96 inches and a width of about 24 inches. It is noted, however, that the panel assemblies 28, 30, 32, 34 can alternatively have, for example, different size widths. For example, an 89×89 inch spa cover 12 can be obtained by each panel assembly 28, 30, 32, 34 having a length of about 89 inches and the outer panel assemblies 28, 32 having a width of about 24 inches each, but the inner panel assemblies 30, 34 having a width of about 20.5 inches each.

As best shown in FIGS. 5 and 6, each panel assembly 28, 30, 32, 34 includes a main body 36, a bottom cover 38, stiffeners 40, and insulating material 42. The main body 36 is molded of a rigid structural plastic. Preferably, the main body 36 is injection molded to form structural foam wherein a plastic starting material such as, for example, polypropylene, polyethylene, or PVC becomes a structural foam during the injection molding process. The main body 36 has a generally planar top wall 44 and a side wall 46 downwardly depending from a periphery thereof to form inner and outer sides or edges 48, 50. The side wall 46 is preferably substantially perpendicular to the top wall 44. Also downwardly extending from the top wall are a plurality of ribs 52 within the side wall 48. The ribs 52 are preferably substantially perpendicular to the top wall 44 and preferably extend in a longitudinal direction of the main body 36. The ribs 52, therefore, divide the main body 36 into a plurality of longitudinally extending interior cavities. The side wall 46 and ribs 52 cooperate to define a generally planar, discontinuous surface to which the bottom cover 38 is attached as described in more detail hereinafter.

The bottom cover 38 is preferably a planer relatively thin sheet. The bottom cover 38 is preferably rigid plastic such as, for example, polypropylene, polyethylene, or PVC, but can alternatively be made of other suitable vapor-impermeable materials. The bottom cover 38 is secured to the bottom of the main body 36 to close the lower open sides of the interior cavities. The bottom cover 38 can be secured in any suitable manner such as, for example, conventional "mushrooms", welding, or adhesives. The side wall 46 and ribs 52 of the main body 36 preferably form a recess or seat 54 for receiving the bottom cover 38 so that the bottom surface of the panel assembly 28, 30, 32, 34 is substantially flat or planar.

The stiffeners 40 are sized and shaped to extend longitudinally within the interior cavities to increase the stiffness of the panel assembly 28, 30, 32, 34. Preferably, there are at least two stiffeners 40, one located adjacent the inner edge and the other located adjacent the outer edge. Each stiffener 40 is preferably V-shaped in cross-section having two legs joined at an angle. The side wall 46 and the adjacent rib 52 preferably form stops 56 for engaging the legs of the stiffeners 40 and retaining the stiffeners 40 therein. The stiffeners 40 are formed of a steel or other suitable material.

The insulating material 42 is located within the interior cavities. The insulating material 42 is preferably a foam and more preferably an expandable foam which substantially fills the entire interior of the panel assembly 28, 30, 32, 34.

The panel assemblies 28, 30, 32, 34 of the present invention are preferably constructed by first molding the main body 36 and then inserting the stiffeners 40 into the interior cavities of the main body 34. The bottom cover 38 is then positioned in the seat 54 and secured to the main body 34, such as by melting "mushrooms". Preferably, the inner side of the bottom cover 38 is pretreated in a suitable manner, such as by flame treatment, so that the foam insulating material adheres to the bottom cover 38 to further secure the bottom cover 38 to the main body 34. Additionally, a waterproof silicone or other suitable sealant is preferably applied between the perimeter of the main body 34 and the bottom cover 38. The silicone forms a waterproof seal therebetween and also further secures the bottom cover 38 to the main body 34. Finally, the assembly 28, 30, 32, 34 is put into a seal fixture and the interior cavities are filled with the foam insulating material 42. Foaming holes, preferably in the ends of the main body 34, are then plugged and the completed panel assembly 28, 30, 32, 34 is removed from the fixture. The panel members 28, 30, 32, 34 are then ready for assembly of the cover members 24, 26.

As best shown in FIGS. 4 and 5, each cover member 24, 26 includes at least one hinge member 58 pivotally connecting and securing together the inner panel assembly 30, 34 to the outer panel assembly 28, 32. The hinge member 58 enables the inner panel assembly 30, 34 to be pivoted about 180° or "folded" onto the outer panel assembly 28, 32, that is, wherein the inner panel assembly 30, 34 rests on the outer panel assembly 28, 32 with the upper surface of the inner panel assembly 30, 34 engaging the upper surface of the outer panel assembly 28, 32 to partially reveal the interior of the spa tub 16. The hinge member 58 is preferably a flexible or living hinge and is preferably formed from an elastomer or flexible plastic. Preferably, longitudinally extending recesses or slots 60 are formed in the upper surface of the panel assemblies 28, 30, 32, 34 which receive ends of the hinge member 58. The hinge member 58 is secured to the panel assembly 28, 30, 32, 34 by a plurality of screws 62 or other suitable mechanical fasteners. In the illustrated embodiment, the screws 62 laterally extend from the edges 48, 50 of the panel assemblies 28, 30, 32, 34 through the hinge member 58 and are counter-sunk to be flush with the edges 48, 50 of the panel assembly 28, 30, 32, 34. The hinge member 58 preferably extends for substantially the entire length of the panel assemblies 28, 30, 32, 34 to completely seal the interface between the panel assemblies 28, 30, 32, 34.

Figure 3A:
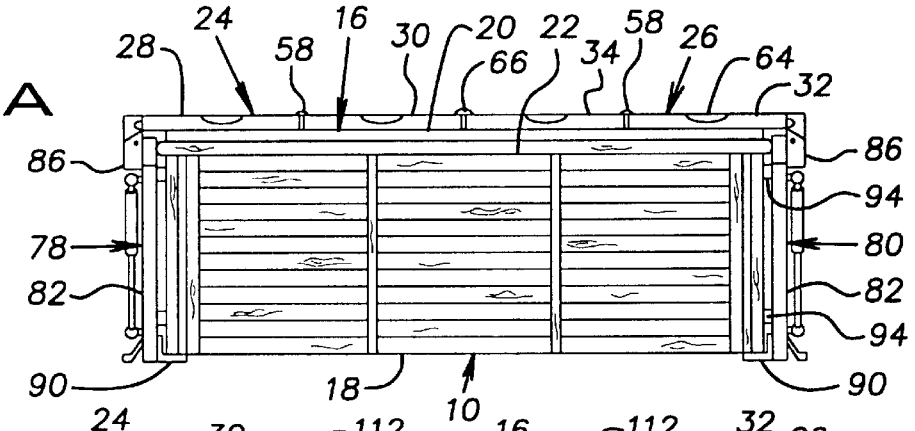
FIG. 3A is a front elevational view of the spa of FIGS. 1 and 2.
Figure 3B:
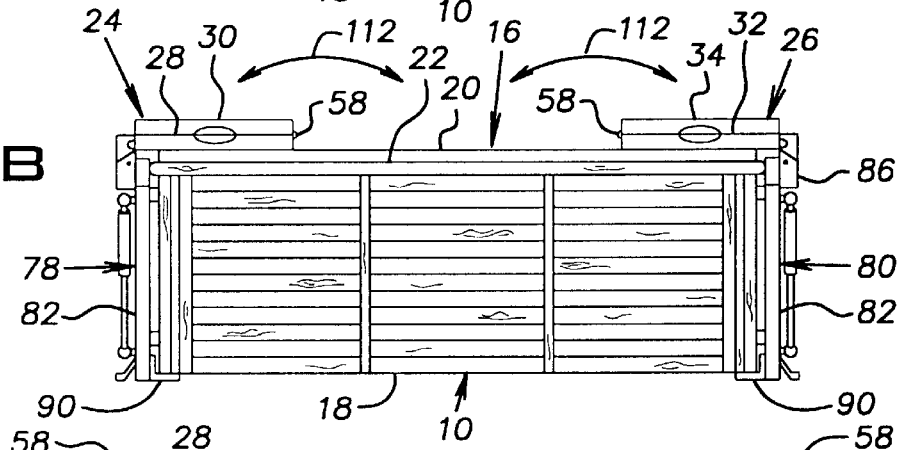
FIG. 3B is a front elevational view similar to FIG. 3A but after a first step of removing the cover.
Figure 3C:
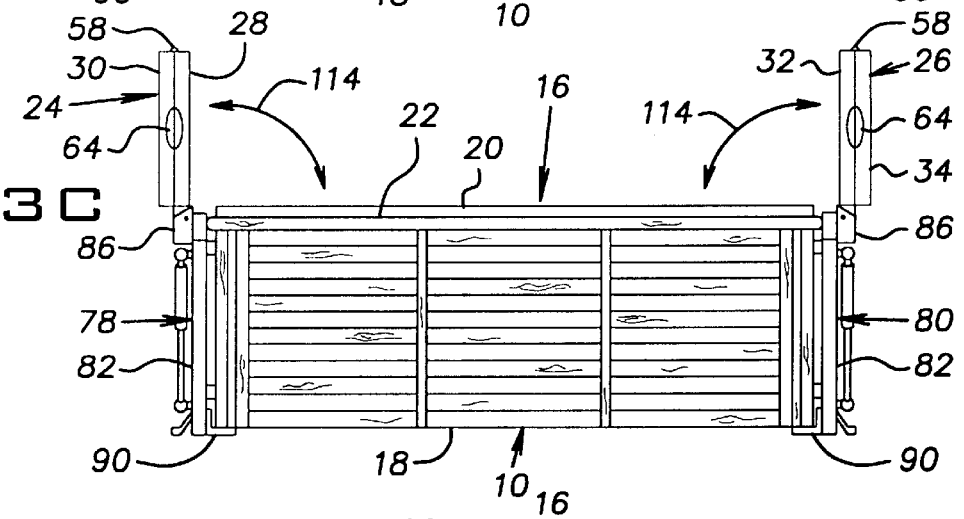
FIG. 3C is a front elevational view similar to FIGS. 3A and 3B but after a second step of removing the cover wherein the cover is in a generally vertical intermediate position located adjacent and above the spa.

Preferably each panel assembly 28, 30, 32, 34 is provided with at least one hand-hold for grasping the panel assemblies 28, 30, 32, 34. In the illustrated embodiment, the upper surface of each panel assembly 28, 30, 32, 34 is provided with a scallop or recess 64 at each end. The scallops 64 preferably form a generally arcuate surface and have both a decreasing, that is tapered, depth and width in a longitudinally inward direction. The hand-hold scallops 64, for example, can have a length of about 10 inches to about 15 inches, a width of about 5 inches to about 8 inches, and a depth tapering from about ½ inch at the edge until flush with the upper surface. As best shown in FIGS. 3B–3C, the scallops 64 of adjacent panel assemblies 28, 30, 32, 34 are shaped and located to cooperate in forming suitable hand-holds for the cover members 24, 26 when the inner and outer panel assemblies 28, 30, 32, 34 are folded together.

As best shown in FIGS. 4 and 6, the spa cover 12 also includes a seal element 66 for sealing the central interface, that is, the interface between the inner panels 30, 34 of the cover members 24, 26. The seal element 66 is secured to one of the inner panel assemblies 30, 34 and is sized and shaped to seal the interface between the inner panel assemblies 30, 34 when the cover is in a closed position but does not secure them together so that the cover members 24, 26 can be folded open. The seal element 66 preferably has a top portion 68 sized to overlap the gap between the inner panel assemblies 30, 34 and engage the upper surface of each of the inner panel assemblies 30, 34. The top portion 68 preferably has an arcuate upper surface which directs water away from the gap. The seal element 66 also has a bottom portion 70 sized to fill the gap between the inner panel assemblies 30, 34 and engage the inner edges 48 of the inner panel assemblies 30, 34 to form a seal therebetween. The bottom portion 70 is preferably bulb-shaped. The seal element 66 is formed from an elastomer or flexible plastic. The seal element 66 is secured to one of the inner panel assemblies 30, 34 by a plurality of screws 72 or other suitable mechanical fasteners. In the illustrated embodiment, the screws 72 laterally extend through the seal element 66 between the top and bottom portions 68, 70 and into the inner edge 48 of the inner panel assembly 30, 34. The seal element 66 preferably extends for substantially the entire length of the inner panel assemblies 30, 34 to completely seal the interface between the inner panel assemblies 30, 34.

Figure 7:
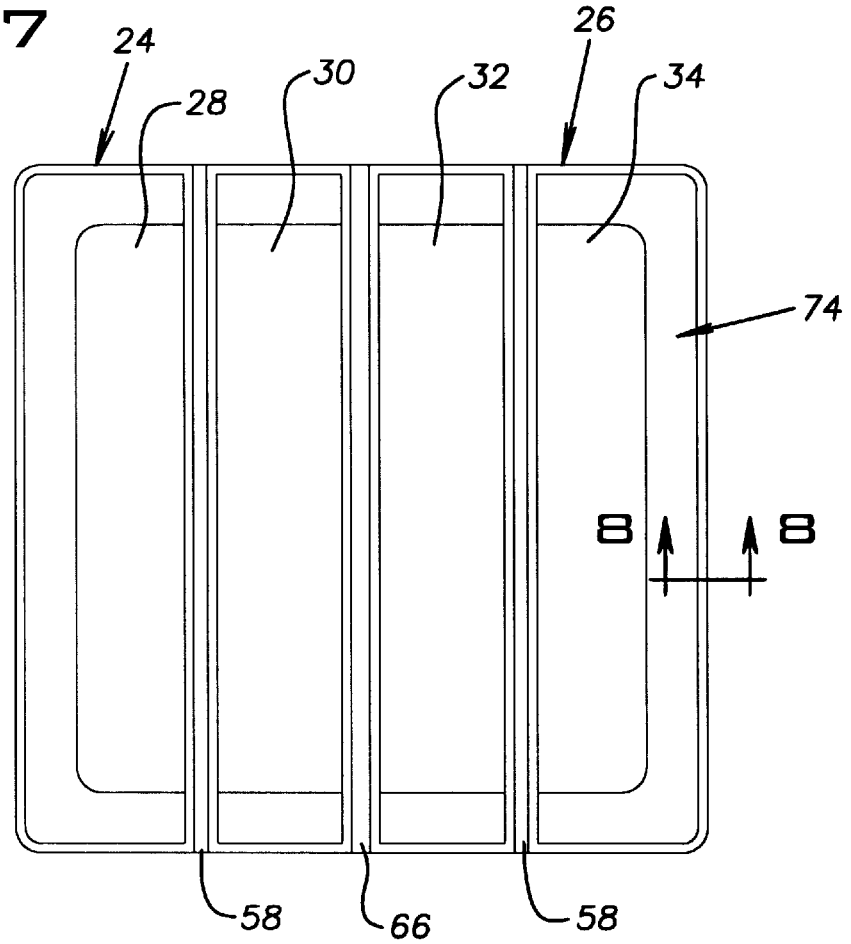
FIG. 7 is a bottom plan view of the spa cover of FIG. 1.
Figure 8:
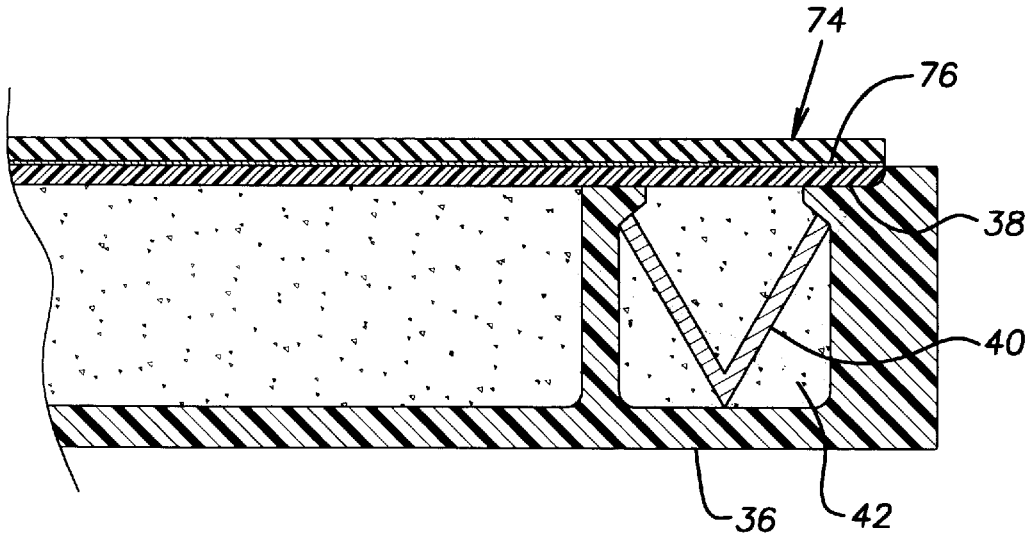
FIG. 8 is an enlarged sectional view taken along line 8—8 of FIG. 7.

As best shown in FIGS. 7 and 8, the spa cover 12 also includes a seal member 74 for sealing the spa cover 12 to the tub rim 20 with a line-contact seal. The seal member 74 extends around the entire periphery of the bottom surface of the spa cover 24. The seal member 74 is interrupted at the interfaces between the panel assemblies 28, 30, 32, 34 to allow them to be folded open as described hereinabove. The illustrated seal member 74 is a flat gasket formed of an elastomer or flexible plastic. Preferably, the seal member 74 is die-cut to closely conform to the periphery of the of the spa cover 12. The seal member 74 has a suitable width to form a seal with spa tubs 16 having rims 20 of varying size. The seal member 74 is secured to the bottom surface of the panel assemblies 28, 30, 32, 34 with a double-back tape 76 or other suitable fastening means. A suitable water-proof double-back tape is available from the 3M Corp. of St. Paul, Minn. It is noted that the seat 54 of the main body 36 for the bottom cover 38 can enlarged so that the seal member 74 is generally flush with the bottom of the main body 36 or alternatively a recess or seat for the seal member 74 can be formed in the bottom cover 38 so that the seal member 74 is generally flush with the bottom surface of the bottom cover 74

As best shown in FIGS. 1 to 3A, the spa cover 12 engages and is supported on the tub rim 16 when it is a cover position over the tub 16. Supported in this manner, a line contact seal is formed by the seal member 74 engaging the tub rim 16. The substantially flat bottom surface of the panel assemblies 28. 30, 32, 34 allows the panel assemblies 28, 30, 32, 34 to overhang the tub 20 in a "table-top" manner so that the spa cover can be used on spa tubs having a range of sizes. The overhang of the panel assemblies 28, 30, 32, 24, however, is preferably no greater than 3 inches. For example, a 96×96 inch spa cover 12 can be utilized with spa tubs 16 having sides in the range of about 90 inches to about 96 inches.

As best shown in FIGS. 1–4 and 9, the lift 14 includes a pair of lift assemblies 78, 80, associated with the first cover member 24 and the second cover member 28 respectively. While two lift assemblies 78, 80 are utilized with the bi-folding spa cover of the present invention, it is noted that only one lift assembly 78, 80 would be necessary for spa covers having a single cover member, whether it is a single panel or multiple panels secured together.

Each lift assembly 78, 80 includes at least two rails 82, blocks 84 linearly movable along the rails 82, hinges 86 connecting the cover member 24, 26 to the blocks 84, and spring members 88 associated with the blocks 84. The rails 82 are each vertically extending and are spaced apart at the side of the spa 10. The lower end of each rail 82 is provided with a base 90 which supports the rail 82. The base 90 of the illustrated embodiment includes a rear foot secured to the lower end of the rail 82 and rearwardly extending under the spa 10 and a front foot secured to the lower end of the rail 82 and forwardly extending away from the spa 10.

Figure 2:
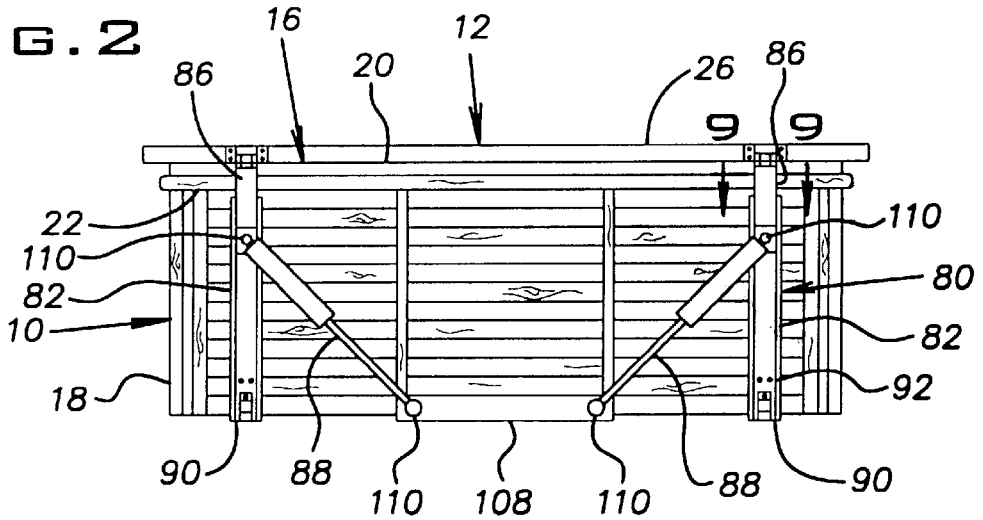
FIG. 2 is a side elevational view of the spa of FIG. 1.
Figure 9:
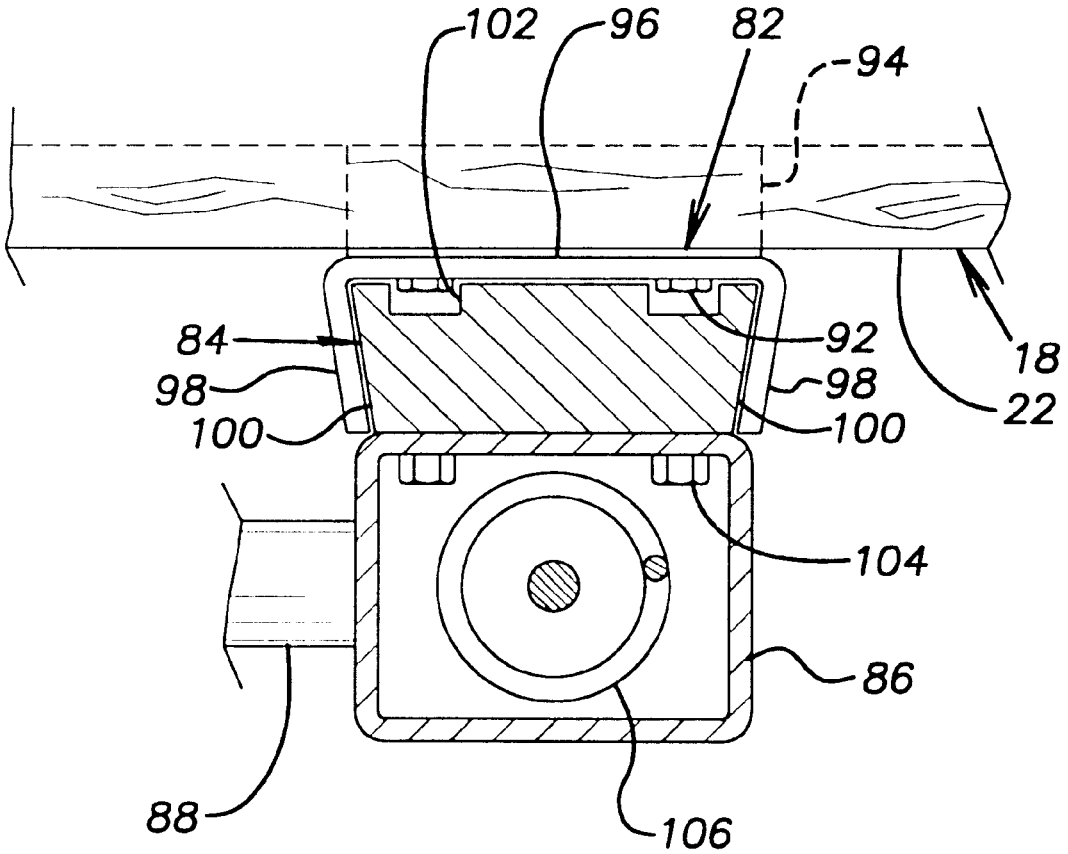
FIG. 9 is an enlarged sectional view taken along line 9—9 of FIG. 2.

Each rail 82 is preferably secured to the spa support structure 18 by suitable fasteners such as the illustrated screws 92 (best shown in FIGS. 2 and 9). It is noted that depending on the size of the spa 10 and the spa cover 12, varying size spacers 94 or shims may be required between the support structure 18 and the rails 82 (best shown in FIGS. 3A and 9). The spacers 94 should be capable giving adjustments of about 3.5 inches for variations in the spa 10. It is also noted that while the illustrated rails 82 are rigidly secured to the spa 10 as described hereinabove, the rails 82 can alternatively be "free standing" if adequate support is provided therefore.

As best shown in FIG. 9, each rail 82 is generally channel-shaped having a main wall 96, side walls 98 inwardly angled from the sides of the main wall 96 so that the channel opening is narrower than the main wall 96.

Each rail 82 has one of the blocks 84 associated therewith. Each block 84 is sized and shaped to be retained within the rail channel for vertical, linear movement of the block 84 along the rail 82. The block 84 of the illustrated embodiment includes angled sides 100 which ride along the side walls 98 of the rail 82. The block 82 vertically rides along the rail 82 but cannot substantially move in either lateral direction relative to the rail 82. An inner surface of the block 84 rides on the main wall 96 of the rail 82 and is provided with channels for passage of the fasteners 92 therethrough. Is noted that the rail 82 and block 84 can have other configurations within the scope of the present invention which interconnect yet allow movement of the block 84 along the rail such as, for example, the rail 82 can have inwardly extending flanges with the block 84 having grooves receiving the flanges.

The cover member 24, 26 is pivotally connected to the blocks 84 by the hinges 86. Each hinge 86 is rigidly secured to the outer surface of the associated block 84 and to the outer edge 50 of the cover member outer panel assembly 28, 32. The hinge 86 is secured by screws 104 or other suitable mechanical fasteners. The hinge 86 is adapted to enable the cover member 24, 26 to be pivoted about 90° between a horizontal plane and a vertical plane (best shown in FIGS. 3B and 3A).

Preferably, each hinge 86 is provided with an associated spring element 106 to bias the hinge 86 toward the position wherein the cover member 24, 26 is in the vertical plane. The spring element 106 is preferably a coil spring and more preferably a compression coil spring. The spring elements 106 are sized to provide a suitable force for assisting manual movement of the cover member 24, 26 from the horizontal plane to the vertical plane. Therefore, the spring elements 106 are sized to at least partially offset the weight of the cover member 24, 26, but not to raise the cover member 24, 26 without application of a manual force. Suitable hinges 86 utilizing compression coil springs are hinges of the type utilized in chest-type freezers.

Each block 84 also has an associated one of the spring members 88 to control movement of the blocks 84 along the rails 82. The spring members 88 are preferably gas springs so that movement of the blocks 84 is also dampened. One end of the spring member 88 is pivotally connected to the outer side of the block 84 below the hinge 86 and the other end of the spring member 88 is pivotably connected to a support base 108. The pivotable connections at the ends of the spring member 88 preferably include suitable ball joints 110. The spring members 88 are preferably sized to provide at least a suitable force for preventing rapid descent of the cover member 24, 26 due to gravity and more preferably sized to provide a suitable force for preventing descent of the cover member 24, 26 due to gravity, yet allowing descent of the cover member 24, 26 when a suitable manual force is applied thereto.

The support base 108 is centrally located between the rails 82 and preferably has a planar foot portion for extending under the spa 10 and flange portion to which the spring members 88 are connected. Located in this manner, the spring members 88 are angled upwardly and outwardly in opposite directions from the support base 108 to the blocks 84 when the blocks 84 are at an upper portion of the rails 82 and are nearly horizontal in opposite directions from the support base to 108 the blocks 84 when the blocks 84 are at a lower portion of the rails 82. It is noted that while the support base 108 is preferably "free standing" as described hereinabove, the support base 108 can alternatively by rigidly attached to the spa 10 if the spa 10 can provide adequate support. It is also noted that the support base 108 can alternatively be integral with or attached to the bases 90 of the rails 82.

As best shown in FIGS. 3A to 3D, the bi-folding spa cover 12 is removed from the spa 10 by removing the cover members 24, 26 in opposite directions. The cover members 24, 26 are each removed by the same procedure. Therefore, the procedure for removing only one of the cover members 24, 26 will be described in detail. It should be appreciated, however, that the procedure equally applies to each of the cover members 24, 26.

Fully removing the multi-panel cover member 24, 26 from a fully closed or covering position to an open or storage position is a three step process. First, the inner panel assembly 32, 34 is manually folded onto the outer panel assembly 28, 32 by grasping the hand-hold scallop 64 of the inner panel assembly 30, 34 and pivoting the inner panel assembly about the hinge member 58 (see FIG. 3B). The inner panel assembly 30, 34 is pivoted about 180° where it is inverted and is again in a generally horizontal plane as indicated by arrows 112 and is supported on the associated outer panel assembly 28, 32. In this partially closed or cover position, an inner portion of the opening of the spa tub 16 is exposed. The cover assembly 24, 28 can remain in this partially covered position if it is desired to expose only a portion of the spa tub 20. The cover member 24, 26 remains in the cover position because the upward bias provided by the spring elements 106 is not great enough to overcome the total weight of the cover member 24, 26 and pivot the cover member 24, 26 without an upward manual force applied thereto as described hereinafter.

It is noted that if the cover member 24, 26 includes additional inner panel assemblies 32, 34 they each are folded until they are all stacked one on-top of another above the outer panel assembly 28, 30. It is also noted that if the cover member 24, 26 has only an outer panel assembly 28, 30, that is there is a total of one panel, this first step of the removal procedure is not necessary.

Second, the folded inner and outer panel assemblies 28, 30 32, 34 are manually rotated upward by grasping the hand-hold scallops 64 and pivoting the cover member 24, 26 about the hinges 86 (see FIG. 3C). The cover member 24, 26 is pivoted about 90° from the generally horizontal plane to a generally vertical plane as indicated by arrows 114 where it is supported by the lift assembly 78, 80. In this intermediate position, the cover member 24, 26 is in a vertical plane and is located adjacent and above the spa 10. The spring elements 106 of the hinges 86 offset at least a portion of the weight of the cover member 24, 26 and thus provide a lift assist in pivoting the cover member 24, 26 from the cover position to the intermediate position. Once in the intermediate position, the spring members 88 support the cover member 24, 26 and preferably prevent downward movement of the cover member 24, 26 due to gravity because the spring members 88 are sized to offset the weight of the cover member 24, 26.

Figure 3D:
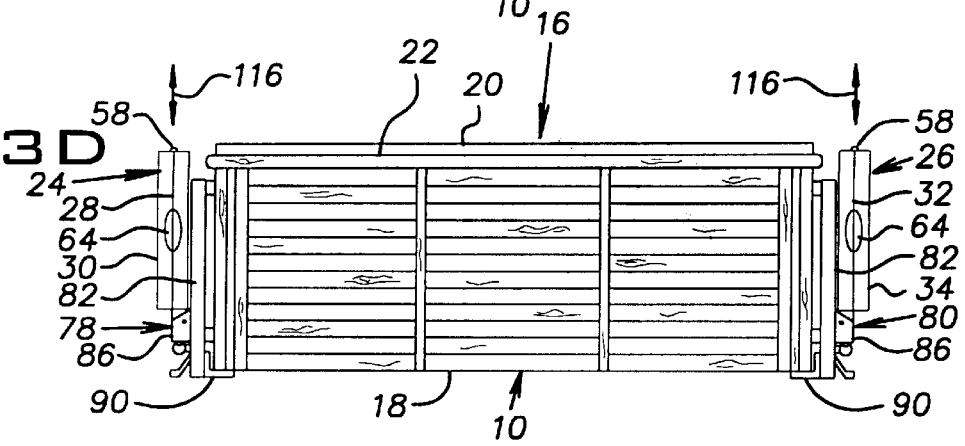
FIG. 3D is a front elevational view similar to FIGS. 3A–3C but after a third step of removing the cover wherein the cover is in a generally vertical storage position located adjacent and beside the spa.

Third, the folded inner and outer panel assemblies 28, 30 32, 34 are manually moved downward by grasping a center portion of the cover member and downwardly pushing the cover member 24, 26 to overcome the upward force of the spring members 88 (see FIG. 3D). The cover member 24, 26 is linearly moved downward, with the blocks 84. along the rails 82 as indicated by arrows 116. Preferably, the cover member 24, 26 is downwardly moved a distance generally equal to the width of the panel assemblies 28, 30, 32, 34 so that the panel assemblies 28, 30, 32, 34 are below or nearly below the height of the tub rim 20 where they are out of sight. In this final or storage position, the cover member 24, 26 is in a vertical plane and is located adjacent and beside the spa 10. The cover member 24, 26 remains in the storage position because the upward bias provided by the spring members 88 is sized to offset the weight of the cover member 26, 28 but not great enough to raise the cover member 24, 26 without applying an upward manual force thereto. It is noted, however, that the spring members 88 do provide a lift assist when returning the cover member to the intermediate position because they do offset the weight of the cover assembly 24, 26. When it is desired to install the cover member 24, 26, the above-described procedure is reversed.

Although particular embodiments of the invention have been described in detail, it will be understood that the invention is not limited correspondingly in scope, but includes all changes and modifications coming within the spirit and terms of the claims appended hereto.

What is claimed is:

1. A cover for covering the top of a spa having a rim, said cover comprising:

a first cover member including a first panel formed of rigid structural plastic and having a top surface, a bottom surface adapted to engage the spa rim, and an inner edge, a second panel formed of rigid structural plastic and having a top surface, a bottom surface adapted to engage the spa rim, an inner edge, and an outer edge adapted to abut said inner edge of said first panel, and a first hinge connecting said first panel and said second panel such that said upper surface of said second panel is pivotable onto said upper surface of said first panel; and a second cover member including third panel formed of rigid structural plastic and having a top surface, a bottom surface adapted to engage the spa rim, and an inner edge, a fourth panel formed of rigid structural plastic and having a top surface, a bottom surface adapted to engage the spa rim, an inner edge adapted to abut said inner edge of said second panel, and an outer edge adapted to abut said inner edge of said third panel, and a second hinge connecting said third panel and said fourth second panel such that said upper surface of said fourth panel is pivotable onto said upper surface of said third panel.

2. The cover according to claim 1, wherein each of said panels form a hollow interior space at least partially filled with insulating foam material.

3. The cover according to claim 1, wherein each of said bottom surfaces of said panels is generally flat and adapted to rest on the spa rim.

4. The cover according to claim 3, wherein said panels are adapted to overhang the spa rim.

5. The cover according to claim 1, further comprising a seal member secured to said bottom surfaces of said panels and adapted to seal said panels to the spa rim.

6. The cover according to claim 5, wherein said seal member is a flat gasket.

7. The cover according to claim 5, wherein said seal member comprises rubber.

8. The cover according to claim 1, wherein said first and second hinges are living hinges.

9. The cover according to claim 1, further comprising a seal element secured to one of said second panel and said fourth panel and adapted to seal said first cover member to said second cover member.

10. The cover according to claim 1, wherein said panels each have recesses in said upper surfaces forming handholds.

11. The cover according to claim 10, wherein said recesses of said first panel cooperate with said recesses of said second panel when said second panel is pivoted onto said first panel.

12. A cover and lift assembly for a spa, said cover and lift assembly comprising:

a cover adapted for covering the spa;

first and second vertically extending and laterally spaced apart rails adapted to be secured adjacent one side of the spa;

first and second blocks vertically movable along said first and second rails respectively; and first and second hinges secured to said first and second blocks respectively and secured to said cover, wherein said cover is pivotable relative to said blocks about said hinges between a generally horizontal cover position over the spa and a generally vertical intermediate position and linearly movable with said blocks along said rails between said intermediate position and a storage position beside the spa.

13. The cover and lift assembly according to claim 12, wherein each of said hinges has a spring element associated therewith to bias said cover toward said intermediate position.

14. The cover and lift assembly according to claim 13, wherein said spring element is a coil spring.

15. The cover and lift assembly according to claim 12, wherein each of said blocks has a spring member associated therewith to upwardly bias said blocks and said cover toward said intermediate position.

16. The cover and lift assembly according to claim 15, wherein said spring member is a gas spring.

17. The cover and lift assembly according to claim 12, wherein said cover includes at least two panels hinged together.

18. A cover and lift for a spa having a rim, said cover and lift comprising:

a bi-folding cover including a first cover member and a second cover member, said first cover member including a first panel having a top surface, a bottom surface adapted to engage the rim, and an inner edge, a second panel having a top surface, a bottom surface adapted to engage the rim, an inner edge, and an outer edge adapted to abut said inner edge of said first panel, and a first hinge connecting said first panel and said second panel such that said upper surface of said second panel is pivotable onto said upper surface of said first panel, said second cover member including third panel having a top surface, a bottom surface adapted to engage the rim, and an inner edge, a fourth panel having a top surface, a bottom surface adapted to engage the rim, an inner edge adapted to abut said inner edge of said second panel, and an outer edge adapted to abut said inner edge of said third panel, and a second hinge connecting said third panel and said fourth second panel such that said upper surface of said fourth panel is pivotable onto said upper surface of said third panel: and said lift including first and second lift assemblies each including first and second vertically extending and laterally spaced apart rails adapted to be secured adjacent one side of the spa, first and second blocks vertically movable along said first and second rails respectively, and first and second hinges secured to said first and second blocks respectively and secured to an associated one of said first and second cover members, wherein said cover members are pivotable relative to said blocks about said hinges between a generally horizontal cover position over the spa and a generally vertical intermediate position and linearly movable with said blocks along said rails between said intermediate position and a generally vertical storage position beside the spa.

19. The cover and lift according to claim 18, wherein said panels are formed of a rigid structural plastic.

20. The cover and lift according to claim 18, wherein each of said bottom surfaces of said panels is generally flat and adapted to rest on and overhang the spa rim.

21. The cover and lift according to claim 18, wherein said cover further includes a flat gasket secured to said bottom surfaces of said panels and adapted to seal said panels to the spa rim.

22. The cover and lift according to claim 18, wherein said hinges each have a spring element associated therewith to bias said hinges and said cover toward said intermediate position.

23. The cover and lift according to claim 18, wherein said blocks each have a gas spring associated therewith to upwardly bias said blocks and said cover toward said intermediate position.

24. A method of installing and removing a spa cover having at least one panel, said method comprising the steps of:

pivoting the panel between a cover position wherein the panel is oriented generally horizontal and is located over the spa and an intermediate position wherein the panel is oriented generally vertical and is located adjacent and above the spa; and linearly moving the panel between the intermediate position and a storage position wherein the panel is oriented generally vertical and is located adjacent and beside the spa.

25. The method according to claim 24, further comprising the step of folding another panel onto and off of the panel when the panel is in the cover position.

26. The method according to claim 24, wherein said step of pivoting the cover includes biasing the cover to the intermediate position with a spring element.

27. The method according to claim 24, wherein said step of vertically moving the cover includes biasing the cover toward the intermediate position with a spring member.

28. The method according to claim 27, wherein said step of vertically moving the cover includes damping movement of the cover.

* * * * *